US006206717B1

(12) United States Patent
Matsumoto

(10) Patent No.: US 6,206,717 B1
(45) Date of Patent: Mar. 27, 2001

(54) CONNECTOR

(75) Inventor: Yasushi Matsumoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/299,443

(22) Filed: Apr. 26, 1999

(30) Foreign Application Priority Data

Apr. 27, 1998 (JP) ..... 10-116486

(51) Int. Cl.[7] ..... H01R 13/627
(52) U.S. Cl. ..... 439/354; 439/923
(58) Field of Search ..... 439/489, 354, 439/923, 152, 680, 374, 352

(56) References Cited

U.S. PATENT DOCUMENTS

| | | | | |
|---|---|---|---|---|
| 4,993,967 | | 2/1991 | Matsumoto | 439/489 |
| 5,178,552 | | 1/1993 | Jinno et al. | 439/140 |
| 5,183,410 | | 2/1993 | Inaba et al. | 439/489 |
| 5,445,534 | * | 8/1995 | Ishizuka et al. | 439/352 |
| 5,823,815 | * | 10/1998 | Takata | 439/374 |
| 6,019,629 | * | 2/2000 | Ito et al. | 439/489 |

FOREIGN PATENT DOCUMENTS

| | | |
|---|---|---|
| 0 554 827 | 8/1993 | (EP) . |
| 0 774 804 | 5/1997 | (EP) . |
| 0 789 425 | 8/1997 | (EP) . |
| 2 218 277 | 8/1989 | (GB) . |

* cited by examiner

*Primary Examiner*—Neil Abrams
*Assistant Examiner*—Michael C. Zarroli
(74) *Attorney, Agent, or Firm*—Anthony J. Casella; Gerald E. Hespos; Michael J. Porco

(57) ABSTRACT

A connector is provided to securely prevent a partial connection while enabling a smooth connection with a mating connector without forcibly turning the mating connector aside. At the front end of the left and right side surfaces of a female housing 1, a pair of spring contact portions 14 laterally symmetrically project in the middle with respect to the height direction of the female housing 1. In the middle of left and right side walls of a receptacle 9 of a male housing 2 with respect to its height direction, a pair of spring accommodating portions 16 in the form of grooves into which the spring contact portions 14 are fittable are formed, and compression coil springs 29 are accommodated therein. When being pushed into the receptacle 9, the female housing 1 is subjected to the reaction forces of the compression coil springs 29. Here, since the pair of compression springs are arranged on the opposite side and in the middle of the receptacle with respect to its height direction, the reaction forces thereof do not turn into such moment forces as to incline the male housing 2. Therefore, the female housing 1 can be inserted into the receptacle without being forcibly turned aside.

13 Claims, 8 Drawing Sheets

CONNECTOR

BACKGROUND OF THE INVENTION

1. Field of the Invention.

The present invention relates to a connector which uses a spring member to prevent a partial connection.

2. Description of the Prior Art.

A prior art connector assembly that uses a spring member to prevent a partial connection is shown in U.S. Pat. No. 5,178,552. This prior art connector assembly comprises a first connector having a hollow receptacle and a mating second connector that is insertable into the receptacle of the first connector. A spring member is provided in the receptacle for applying a repulsive spring force to the second connector if the second connector is not correctly mated to the first connector. A spring receiving device is arranged between the second connector and the spring member for transmitting the repulsive spring force. However, since the compression spring comes into contact only with the upper end of the spring receiving device, the reaction force of the spring member tends to incline the spring receiving device. Consequently, there are disclosed guiding means which comprise lateral projections on the spring receiving device. The lateral projections are intended to guide the spring receiving device by interacting with grooves provided in the receptacle. However, the guiding means only can prevent the inclination of the spring receiving member to a limited extent, and the residual inclination or tilt makes the connection operation of the connector more difficult.

The present invention was developed in view of the above problem and an object thereof is to provide a connector which can ensure a smooth connection with a mating connector, in particular without forcibly turning the mating connector aside and securely preventing a partial connection.

SUMMARY OF THE INVENTION

According to the invention, there is provided a connector, comprising a receptacle into which at least one mating connector is fittable. A lock portion is provided for holding the connector and the mating connector in a connected state. At least one terminal fitting is provided in the connector for electrical connection with the mating connector at least after completion of the connection with the mating connector.

At least one pair of compression springs are provided in or on walls of the receptacle, for compression during the connection of the two connectors. The springs preferably are in spring accommodating portions of the walls, while being directly or indirectly held substantially in contact with spring contact portions provided in corresponding positions on the mating connector. The compression springs are in positions on substantially opposite sides of the receptacle with respect to its widthwise direction, and in or near the middle of the receptacle with respect to its height direction.

According to a preferred embodiment, there is provided a connector, comprising a receptacle into which a mating connector is fittable. A lock portion is provided for holding the connector and the mating connector in a connected condition. At least one terminal fitting is provided in the connector for electrical connection with the mating connector after completion of the connection with the mating connector.

A pair of compression springs are provided in inner walls of the receptacle for compression during the connection of the two connectors. The compression springs may be held in contact with spring contact portions provided on the mating connector. Additionally, the compression springs are provided on opposite sides of the receptacle with respect to its widthwise direction and near the middle of the receptacle with respect to its height direction.

Accordingly, the compression springs are compressed by being pressed by the spring contact portions of the mating connector while the mating connector is being fitted into the receptacle of the connector. The two connectors are locked by the lock portion after the connectors have been completely connected and while the at lest one terminal fitting is electrically connected. If the mating forces are stopped before complete connection, the two connectors are separated from each other to a considerable degree by the elastic restoring forces of the compression springs, thereby preventing a partial connection. Here, since the pair of compression springs are arranged on the opposite sides of the receptacle and near the middle of the receptacle with respect to its height direction, the reaction forces do not turn into moment forces that would incline the mating connector. Therefore, the mating connector can be inserted into the receptacle without being forcibly turned aside.

Preferably, the spring contact portions of the mating connector are provided to be asymmetric with respect to the height direction of the mating connector and are formed by a pair of upside-down insertion preventing ribs for preventing the upside-down insertion of the two connectors. The receptacle also is provided with a pair of guide recesses into which the ribs are fittable, and the compression springs are arranged in the guide recesses. Accordingly, since the spring contact portions and the accommodating portions for the compression springs also act as the upside-down insertion preventing ribs for preventing the upside-down insertion of the two connectors, the connector can be made more compact as compared with those having separate portions for performing such a function.

Contact members that are displaceable along the spring accommodation portions preferably are provided between the compression coil springs and the corresponding spring contact portions of the mating connector. The contact members may comprise guided portions that may be guided in guide grooves provided in the spring accommodation portions. Thus, the contact members are guided smoothly.

The guide grooves may comprise an interaction portion and a retracted portion. The contact members are or can be brought substantially into contact with the corresponding spring contact portion, when the guided portions are located in the interaction portion. Conversely, the contact members are retracted or retractable or separated or separable from the corresponding spring contact portion, when the guided portions are located in the retracted portion.

Most preferably, the interaction portion and the retracted portion are arranged at an angle different from 0° and 180° with respect to each other.

According to a further preferred embodiment, the guide grooves comprise a rotation permitting portion. Thus the contact members are or can be rotated substantially around their vertical axis, preferably by contact with the corresponding spring contact portion, for a disengagement of the contact members and the corresponding contact portions.

Preferably, the compression springs bias the contact members towards their original rotational position.

Further preferably, the contact members comprise a tapered surface which can interact with a mating tapered surface of the spring contact portion, preferably upon disengagement of the two connectors, thereby causing the rotation of the contact members substantially around their vertical axis. In other words the contact member comprises a surface (tapered surface) for permitting the passage of the spring contact portion in the withdrawing or detaching or disconnecting direction by its rotation.

Most preferably, the compression springs are mounted to the housing of the connector by means of boss portions.

Furthermore, the invention provides a connector assembly or construction comprising a connector according to the invention and a mating connector.

These and other objects, features and advantages of the present invention will become more apparent upon a reading of the following detailed description and accompanying drawings.

DETAILED DESCRIPTION OF THE PREFERRED EMBODIMENT

Figure 1:
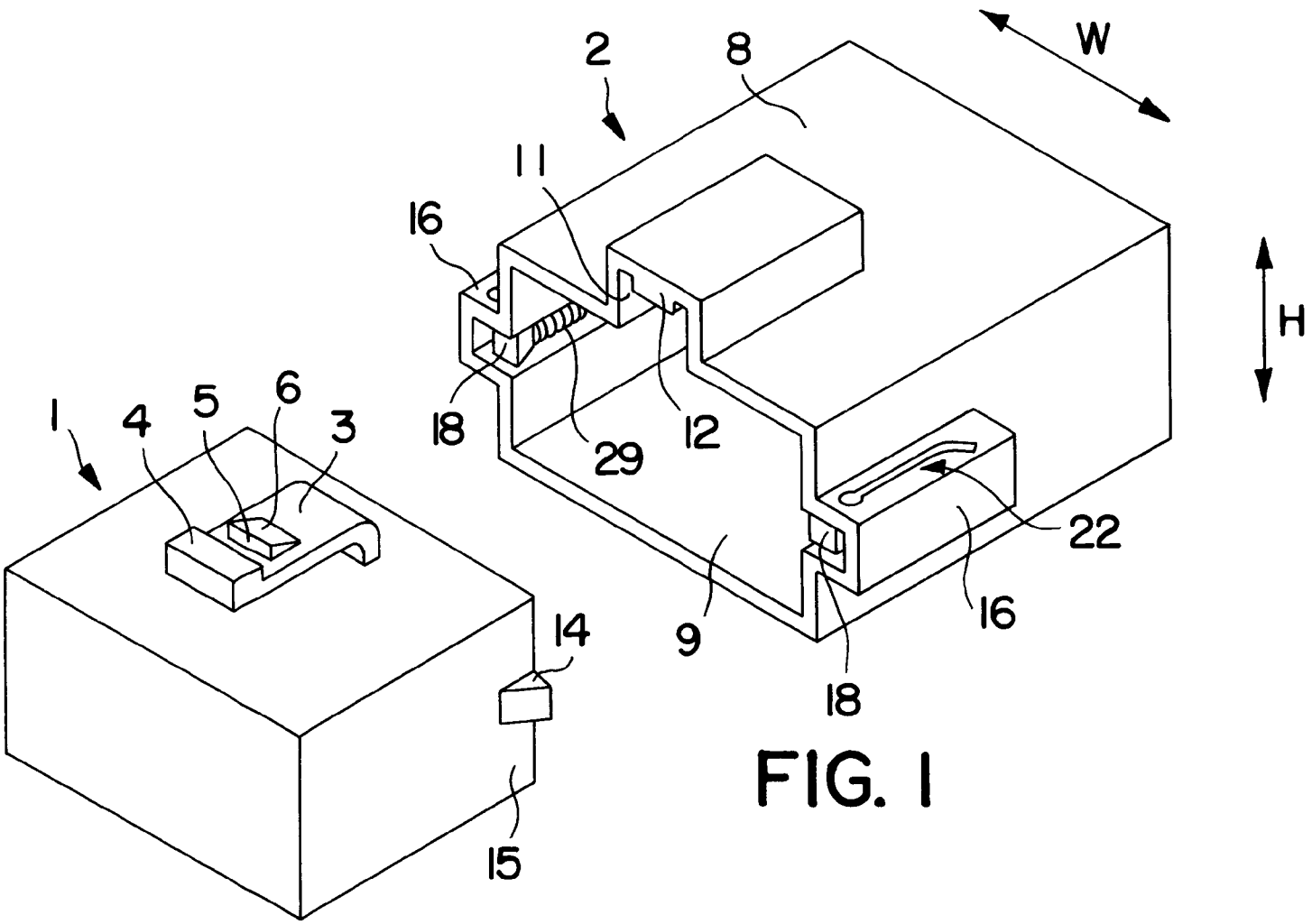
FIG. 1 is a perspective view showing the external configuration of male and female housings according to a first embodiment of the invention.

A connector according to a first embodiment is shown in FIGS. 1–10. The connector is comprised of a female connector housing 1 (hereinafter, "female housing 1") and a male connector housing 2 (hereinafter, "male housing 2") to be connected with each other as shown most clearly in FIGS. 1–3. The respective housings 1, 2 are formed with cavities in which female and male terminal fittings are accommodated, respectively. The cavities, however, are not shown in order to make the drawings simpler. Hereinafter, the sides of the respective housings 1, 2 that are to be connected are referred to as the fronts.

The female housing 1 is made e.g. of a synthetic resin and preferably has a substantially rectangular parallelepipedic shape. Unillustrated male terminal fittings are inserted preferably through the rear surface of the female housing 1 for accommodation therein. A lock arm 3 is provided substantially in the middle on the upper surface of the female housing 1 with respect to its widthwise direction W. This lock arm 3 extends at an angle different from 0° or 180°, and preferably substantially normal to or upwardly from a front end position. Additionally, the lock arm 3 is bent toward the back. A free end, where a pushing portion 4 is provided, is deflectable in a downward direction by the elastic deflection of at least part of the lock arm 3. A lock projection 5 is provided substantially in a middle portion of the lock arm 3 with respect to its longitudinal direction, and a front surface of the lock projection 5 is made into a tapered surface 6.

Figure 2:
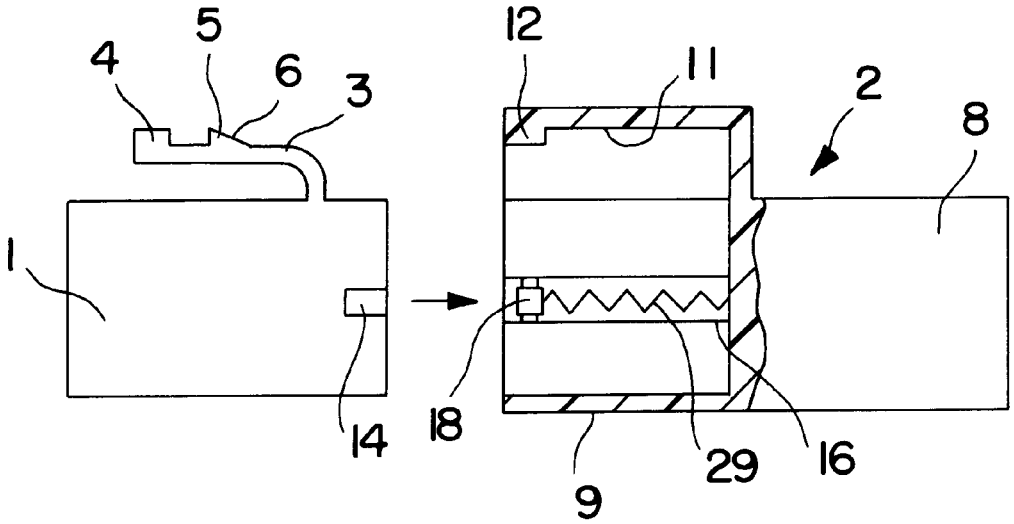
FIG. 2 is a side view partly in section of the male and female housings before being connected.

The male housing 2 likewise is made of a synthetic resin and preferably has a rectangular parallelepipedic shape substantially larger than the female housing 1. A front part of a main body 8 is formed with a receptacle 9 into which the female housing 1 is at least partly fitted or fittable. Unillustrated male terminal fittings are inserted into the main body 8 preferably through the rear surface thereof, and are accommodated in the main body 8 while projecting into the receptacle 9. In the ceiling surface of the receptacle 9 of the male housing 2 is bulgingly formed an entrance path 11 along which the lock arm 3 of the female housing 1 can substantially pass. A locking portion 12 projects at the front edge of the ceiling of the entrance path 11 and is engageable with the lock projection 5 of the lock arm 3, as shown in FIG. 2.

A pair of spring contact portions 14 are so formed as to project laterally and substantially symmetrically preferably in middle positions of the front edge of the left and right side surfaces of the female housing 1 with respect to the height direction H of the female housing 1. The outer surface of each spring contact portion 14 is formed into a tapered surface 15 of a specified angle different from 0° or 180° so that the thickness of the spring contact portion 14 gradually reduces toward the back.

A pair of spring accommodating portions 16 are formed in corresponding, preferably middle positions of the left and right side surfaces of the receptacle 9 of the male housing 2 with respect to the height direction of the male housing 2. The spring accommodating portions 16 are in the form of grooves into which the spring contact portions 14 of the female housing can at least partly enter. Compression coil springs 29 are or can be accommodated in the spring accommodating portions 16. The rear ends of the compression coil springs 29 are fitted or fittable on boss portions 28 formed at the back surfaces of the spring accommodating portions 16 so as to be positioned substantially inside and not to come out of the spring accommodating portions 16.

Figure 4:
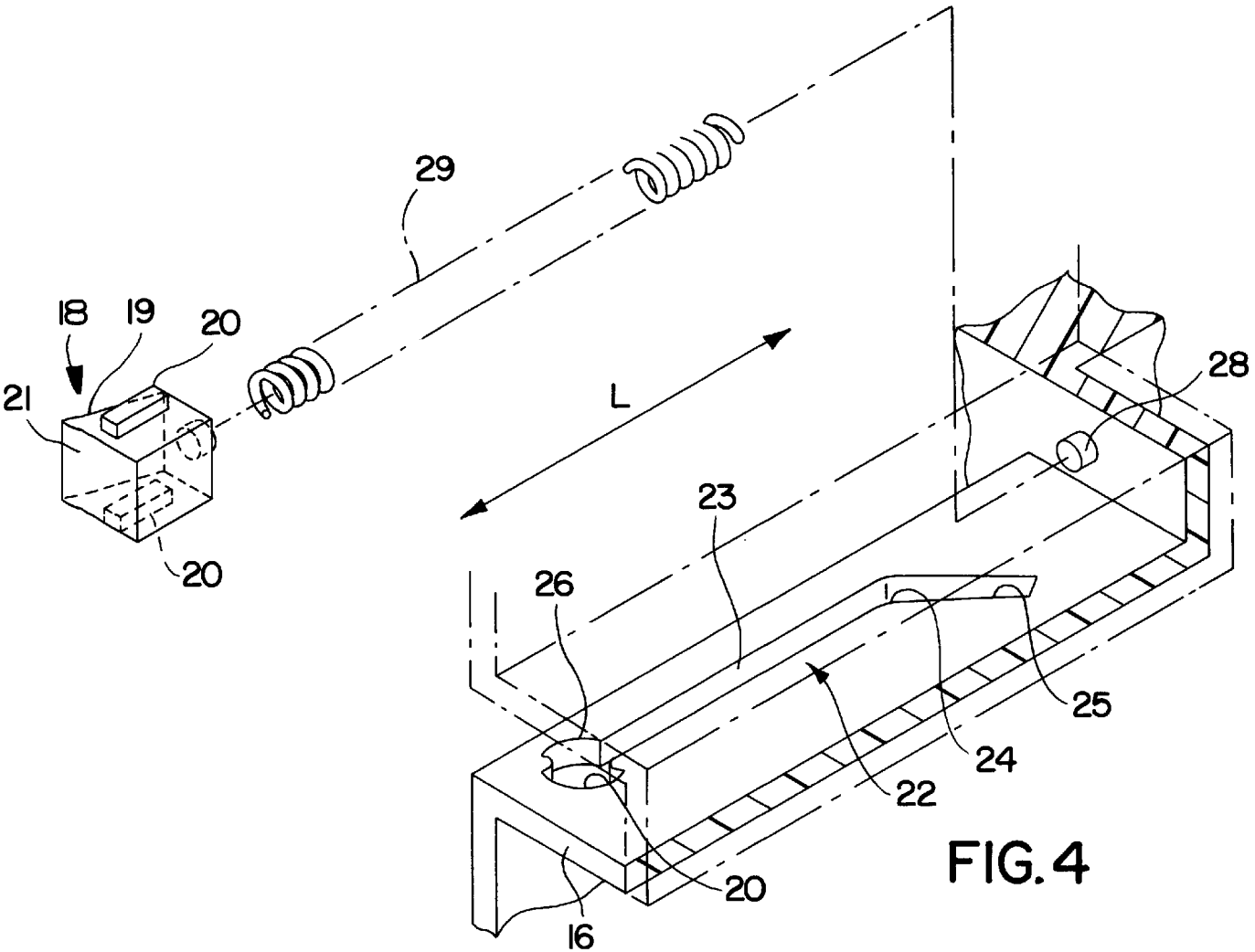
FIG. 4 is an exploded perspective view showing a mount portion of a contact member and a compression coil spring.

A contact member 18 is mounted at the leading end of each compression coil spring 29 and is movable substantially forwardly and backwardly or along a longitudinal direction L in the spring accommodating portion 16. Each contact member 18 is in the form of a block having such a height as to be fittable in the spring accommodating portion 16 as shown in FIG. 4. Each contact member 18 has a tapered upwardly facing surface 19 substantially matching or corresponding to the tapered surface 15 of the spring contact portion 14 of the female housing 1. A pair of elongated projections 20 extending along forward and backward directions are substantially symmetrically formed on the upper and lower surfaces of the contact member 18.

Figure 5:
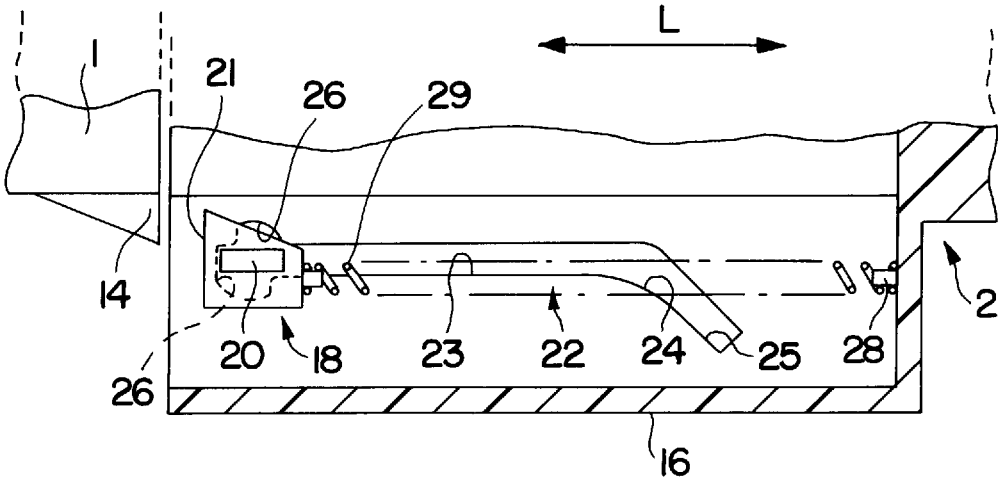
FIG. 5 is a section showing a guide portion before the male and female housings are connected.

The upper and lower surfaces of the spring accommodating portion 16 are formed with guide grooves 22. The upper and lower elongated projections 20 of the contact member 18 are fitted or fittable in guide grooves 22 to slidably guide the contact member 18. Each guide groove 22 has a substantially linear portion 23 (interaction portion) substantially extending along the longitudinal or forward and backward directions L as shown in FIG. 5. While the contact member 18 or its elongated projections 20 is/are located in the linear portions 23 of the guide groove 22, a preferably inward projecting portion (contact portion 21) on the front and/or inwardly lateral surface of the contact member 18 can project to a position where it can contact the spring contact portion 14 of the female housing 1. A retracted portion 25 of the guide groove 22 obliquely projects outward and is formed continuously with the rear end of the linear portion 23 via a bent portion 24. In other words, the retracted portion 25 extends at an angle different from 0° or 180° with respect to the linear portion 23 and/or with respect to the longitudinal direction L. The bent portion 24 is formed to have a larger width so as to permit the projection 20 to be turned or rotated around its vertical axis or axis substantially normal to the longitudinal direction L. In the case that the contact member 18 is moved to the retracted portions 25, it is retracted away or positioned at a distance from the spring contact portion 14. Furthermore, rotation permitting portions 26 are formed at the left and right sides of the front end of each linear portion 23 for permitting the rotation of the projection 20 and the contact member 18.

The embodiment constructed as described above acts as follows. The contact members 18 and the compression coil springs 29 are mounted preferably in both spring accommodating portions 16 of the male housing 2. More particularly, the contact members 18 are located substantially at the front ends of the guide grooves 22 as shown in FIG. 5, and are biased forwardly by the elastic restoring forces of the compression coil springs 29. The contact portions 21 of the contact members 18 substantially project into entrance ranges of the spring contact portions 14 of the female housing 1. In this state, the female housing 1 is pushed into the receptacle 9 of the male housing 2 as indicated by an arrow in FIG. 2.

Figure 6:
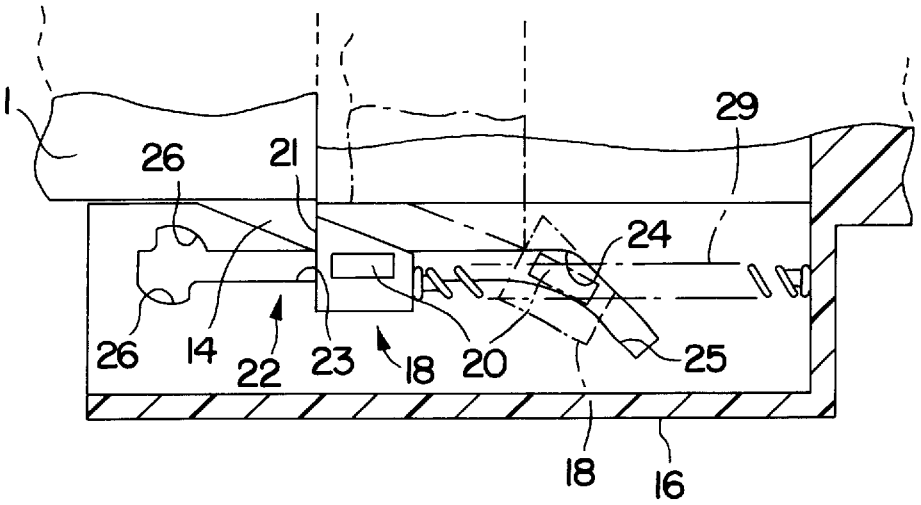
FIG. 6 is a section showing the guide portion while the male and female housings are being connected.

The spring contact portions 14 come into contact with the contact portions 21 of the contact elements 18 as shown in FIG. 6 when the female housing 1 is fitted into the receptacle 9. The spring contact portions 14 move the contact members 18 backward by compressing the compression coil springs 29 along the linear portions 23 of the guide grooves 22 as the female housing 1 is pushed.

Here, since the pair of compression coil springs 29 preferably are provided on the opposite sides of the receptacle 9, the reaction forces of the compression coil springs 29 substantially equally act on the male housing 2 along its transverse direction. Accordingly, there is no likelihood that the male housing 2 is inclined with respect to its transverse direction. Further, since the compression coil springs 29 are provided substantially in the middle of the receptacle 9 along vertical direction H, the reaction forces thereof do not turn into moment forces that would incline the male housing 1. As a result the male housing 2 is not inclined with respect to vertical direction. Thus, the female housing 1 is inserted into the receptacle 9 substantially without being forcibly turned aside.

When the female housing 1 is pushed further, the projections 20 slide into the retracted portions 25 via the bent portions 24. As a result the contact members 18 gradually escape outwardly. During this time, the lock projection 5 of the lock arm 3 comes into contact with the locking portion 12, thereby elastically deforming the lock arm 3 downwardly.

Figure 3:
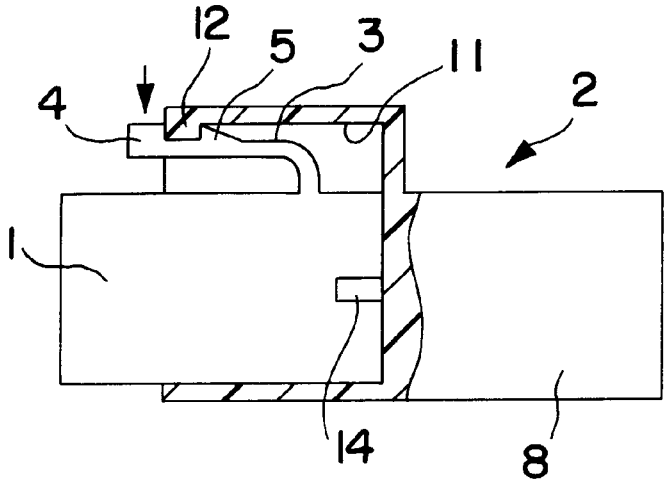
FIG. 3 is a side view partly in section of the male and female housings connected with each other.
Figure 7:
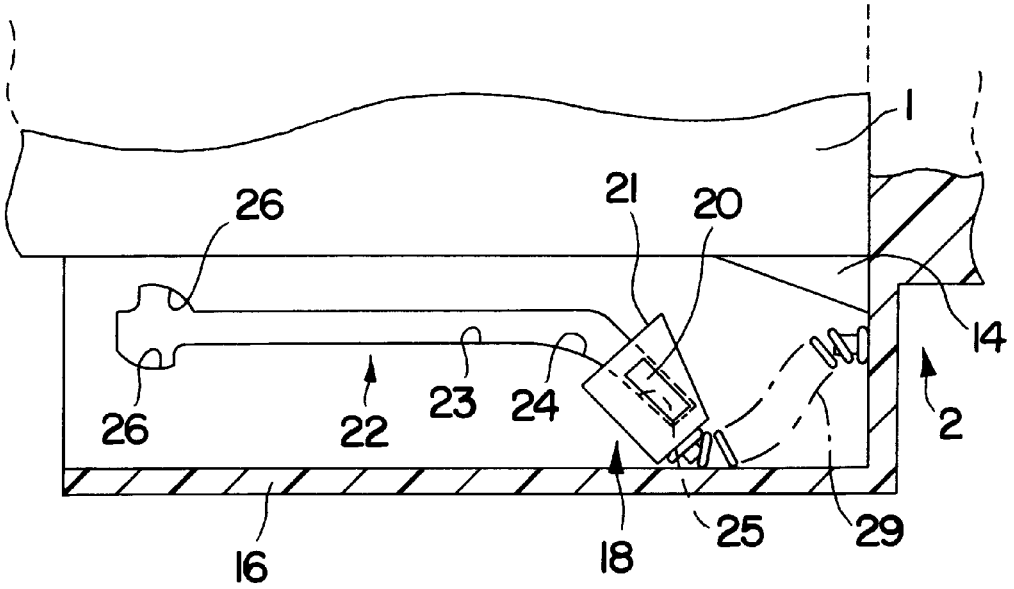
FIG. 7 is a section showing the guide portion when the female housing is pushed to its proper position.
Figure 8:
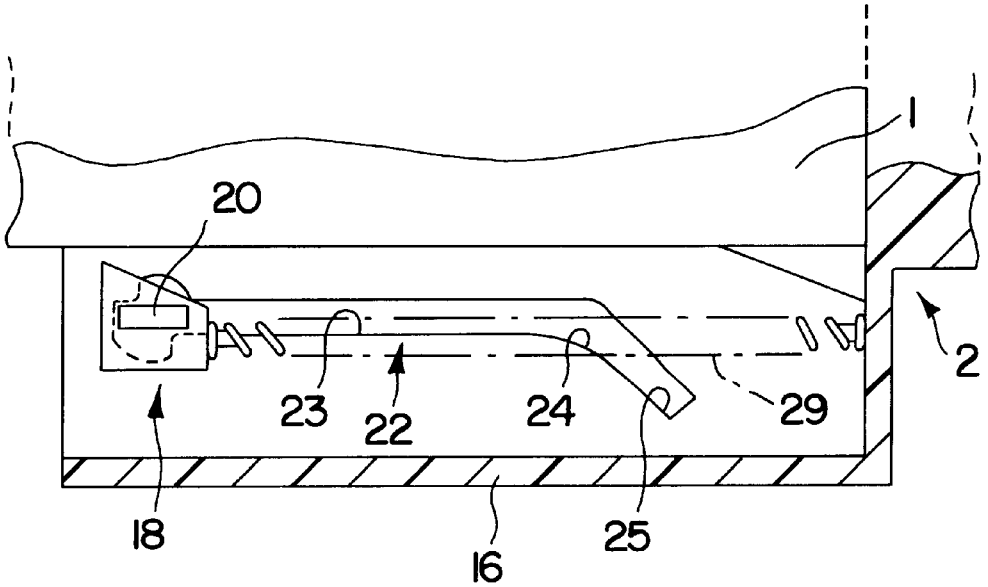
FIG. 8 is a section showing the guide portion when the contact member is returned to its original position.

Movement of the female housing 1 to its proper connection position by an inertial force causes the contact members 18 to be moved substantially completely to the retracted portions 25, as shown in FIG. 7, and hence causes the contact members 18 to be disengaged substantially laterally from the spring contact portions 14. If the male and female housings 2, 1 are substantially properly connected, the spring contact portions 14 pass the positions of the contact members 18. Accordingly, the contact members 18 are or can be returned to their original positions at the front ends of linear portions 23 via the bent portions 24 by the elastic restoring forces of the compression coil springs 29, as shown in FIG. 8. The contact members 18 abut against or interact with the front ends of the linear portions 23, and thereby are positioned in their original or stand by positions. Accordingly, it is possible to visually verify or control that the contact members 18 are returned to their original positions thereby improving the operability of the connector or connector assembly. At the time when the female housing 1 is pushed to its proper position, the lock arm 3 recovers its substantially original shape and the lock projection 5 is brought or is bringable into engagement with the rear surface of the locking portion 12, as shown in FIG. 3. As a result, the housings 1, 2 are locked so as not to be disengaged from each other.

If the housings 1, 2 are left only partly connected during the above connection operation, the spring contact portions 14 of the female housing 1 push the contact members 18 while contracting the compression coil springs 29 as shown in FIG. 6. Accordingly, the contact members 18 push the spring contact portions 14 with the elastic restoring forces of the compression coil springs 29, thereby pushing the female housing 1 to a considerable degree. This prevents the housings 1, 2, from being left only partly connected.

Figure 9:
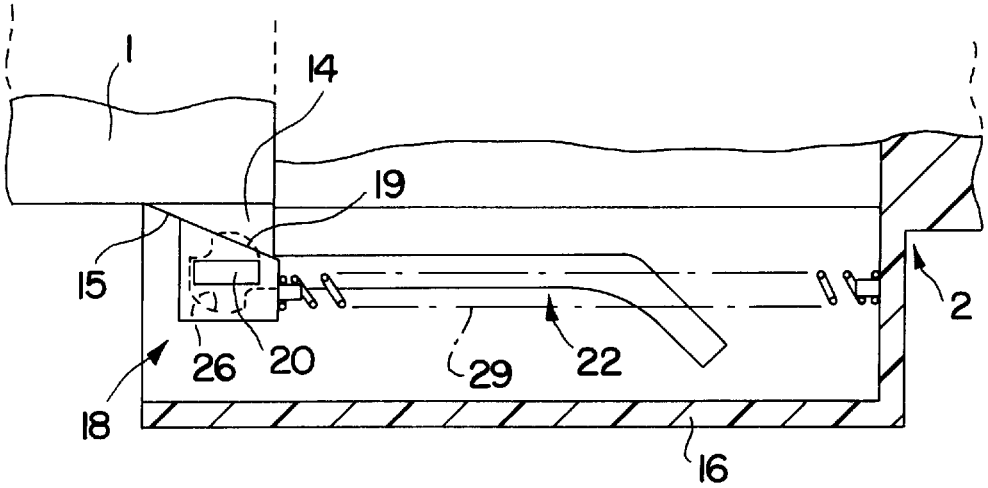
FIG. 9 is a section showing the guide portion while the male and female housings are being detached.
Figure 10:
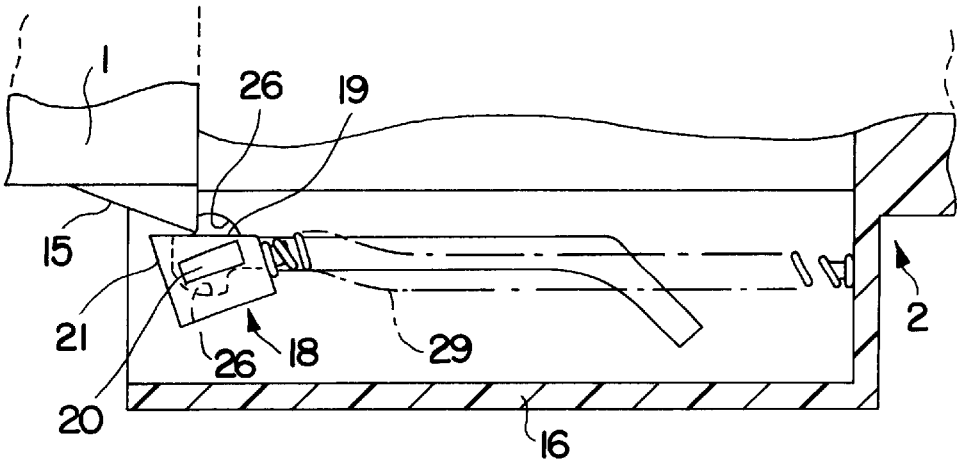
FIG. 10 is a section showing the guide portion when the contact member is turned.

Housings 1, 2 that have been connected properly as shown in FIGS. 3 and 8, can be detached by pushing the pushing portion 4 as indicated by an arrow in FIG. 3 to elastically deform the lock arm 3 downward, and thereby to unlock the locking portion 12. Thereafter, the female housing 1 is pulled out. When the female housing 1 is pulled up to the vicinity of the entrance of the receptacle 9, the tapered surfaces 15 of the spring contact portions 14 substantially come into contact with the tapered surfaces 19 of the contact members 18 as shown in FIG. 9. When the female housing 1 is further pulled, the tapered surfaces 19 of the contact members 18 are pushed by the spring contact portions 14 as shown in FIG. 10. Accordingly, the female housing 2 is pulled out while the projections 20 are turned in the rotation permitting portions 26 of the guide grooves 22. The contact members 18 elastically deform the compression coil springs 29, thereby bending them and have their tapered surfaces 19 inclined preferably so as to at most substantially extend along the longitudinal or forward and backward directions L. The spring contact portions 14 then slide over the tapered surfaces 19. The contact members 18 are returned to their original orientation as the compression coil springs 29 substantially recover their original shapes.

As described above, according to this embodiment, the partial connection is prevented by pushing the female housing 1 back to a considerable degree by the elastic restoring forces of the compression coil springs 29 in the case that the housings 1, 2 are left only partly connected. Further, since a pair of the compression coil springs 29 are arranged on the opposite side of and in the middle of the receptacle 9 with respect to vertical direction, the reaction forces of the compression coil springs 29 do not turn into such moment forces as to incline the male housing 2. Thus, the female housing 1 can be inserted into the receptacle 9 without being forcibly turned aside. Furthermore, since the compression coil springs 29 recover their original shapes after the housings 1, 2, are properly connected, the settling thereof can be securely prevented and, therefore, they can repeatedly perform the partial connection preventing function. Furthermore, since the contact member 18 return to their original positions in case the female housing 1 and the male housing 2 are substantially properly mated or connected, a control (preferably visual) of the connection is possible.

Figure 11:
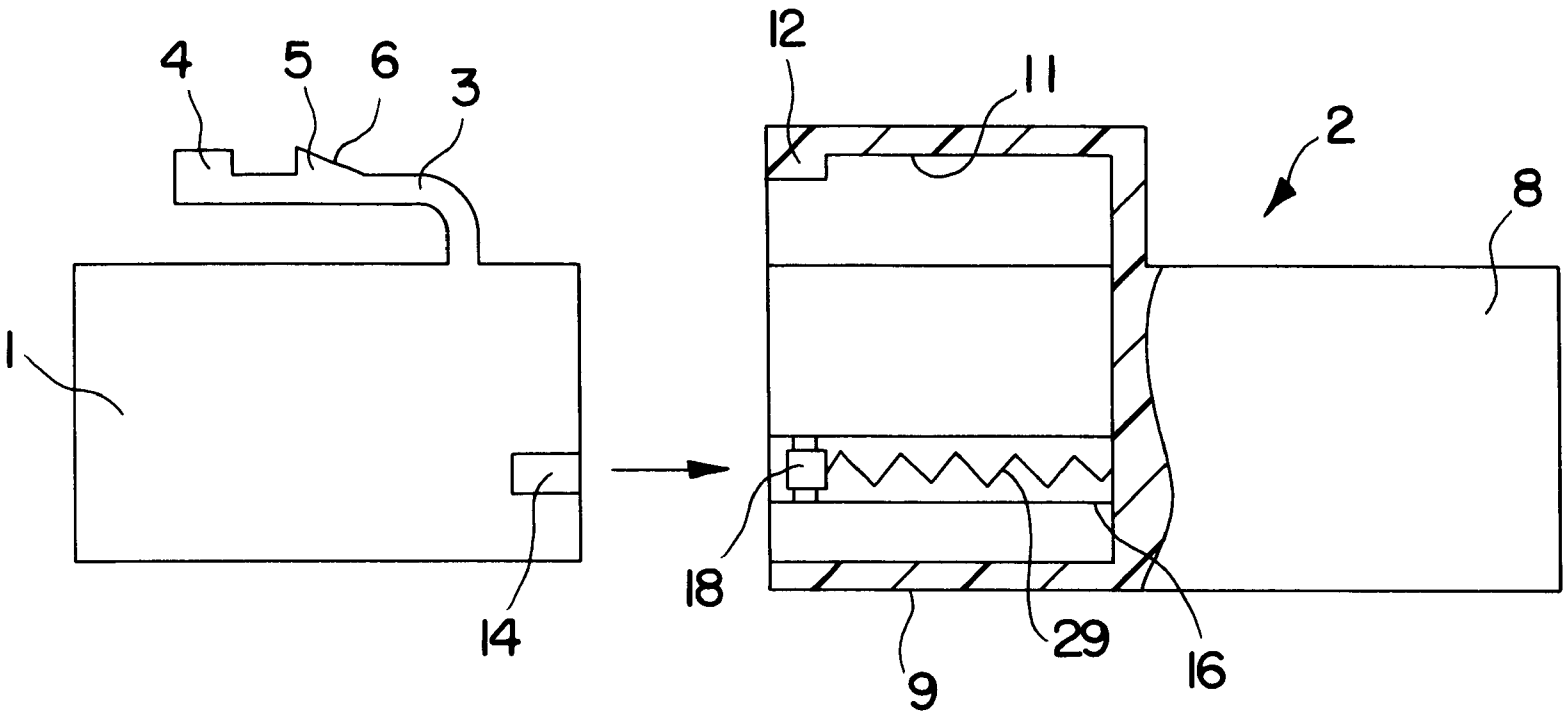
FIG. 11 is a side view partly in section of a connector according to a second embodiment before connection.

The spring contact portions 14 and the spring accommodating portions 16 according to a second embodiment are shifted slightly downward or along the height direction H from those according to the first embodiment as can be seen by comparing FIGS. 2 and 11. Such an arrangement makes the spring contact portions 14 substantially asymmetric with respect to the height direction of the female housing 1, thereby acting as upside-down insertion preventing ribs for preventing the female housing 1 from being inserted into the male housing 2 upside down, and makes the spring accommodating portions 16 act as guide recesses for guiding the upside-down insertion preventing ribs.

Since the other construction is the same or similar as that of the first embodiment, no description is given thereon.

According to the connector of the second embodiment, the spring contact portions 14 and the spring accommodating portions 16 also act to prevent the upside-down insertion of the housings 1, 2. Thus, the connector can be made more compact as compared with one having separate portions for performing this function. Further, since the compression coil springs 29 are near the middle of the female housing 1 with respect to its height direction although they are displaced therefrom, the reaction forces of the compression coil springs 29 do not turn into such moment forces as to incline the male housing 2.

Figure 12:
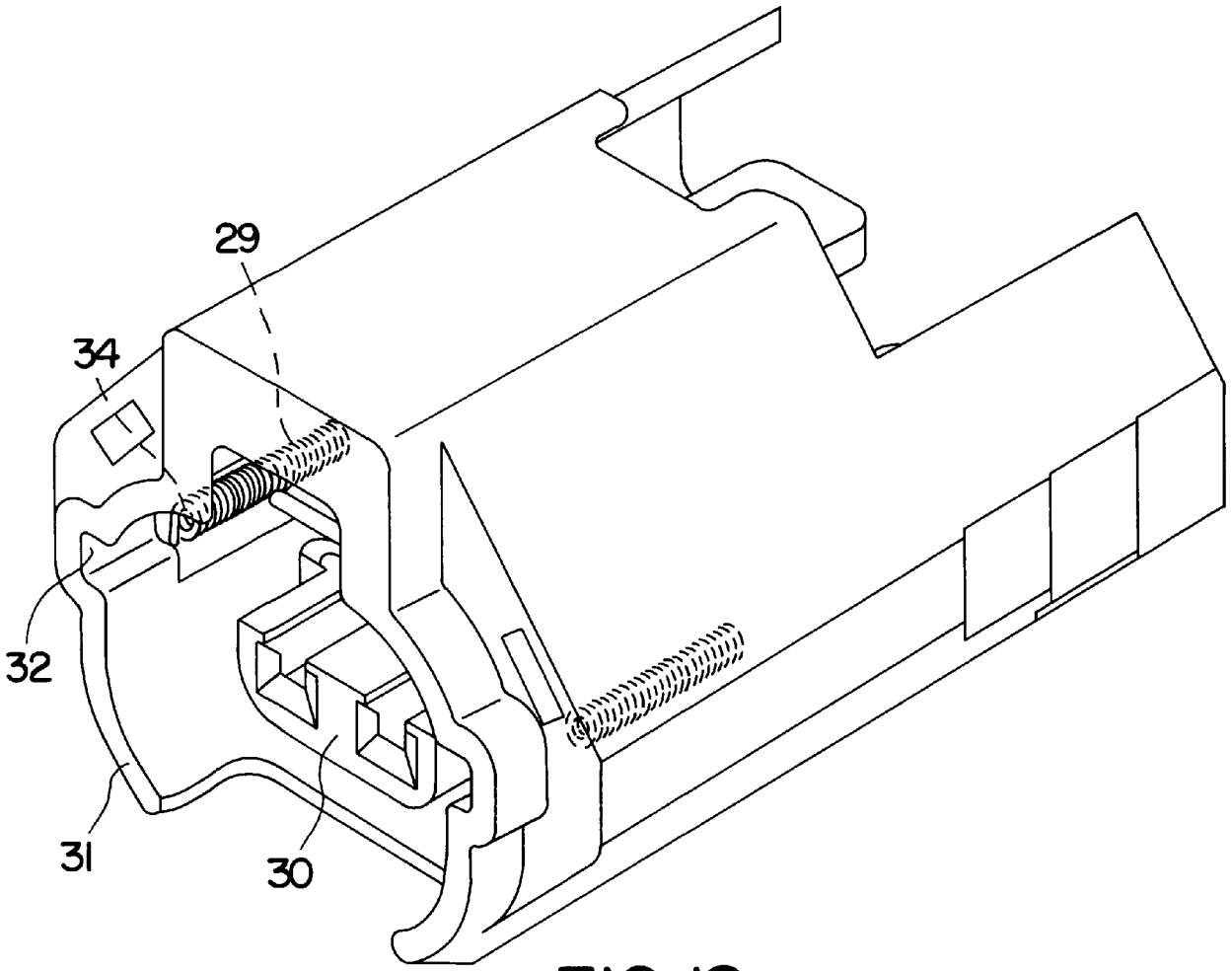
FIG. 12 is a perspective view of a connector according to a third embodiment.

A connector according to a third embodiment shown in FIG. 12 is a female connector constructed such that an accommodating portion 30 in which female terminal fittings can be accommodated is surrounded by a receptacle 31. A receptacle of an unillustrated mating male connector is inserted between the receptacle 31 and the accommodating portion 30. The receptacle 31 of this connector is formed, in positions on the substantially opposite side with respect to its widthwise direction and slightly displaced upward from the middle position with respect to its height direction, with a pair of guide grooves 32 into which upside-down insertion preventing ribs provided on the receptacle of the mating connector can enter. Compression coil springs 34 are accommodated in the guide grooves 32.

In this way, the present invention may be applied to the female connector for accommodating the female terminal fitting by providing it with the receptacle.

The present invention is not limited to the described and illustrated embodiments. For example, the following embodiments are also embraced by the technical scope of the present invention as defined in the claims. Besides the following embodiments, a variety of other changes can be made without departing from the scope and spirit of the invention as defined in the claims. The contact members and/or the compression coil springs may be provided on the male housing provided with a lock arm. Instead of the compression coil springs, other types of compression springs such as those formed by bending strip-shaped leaf springs in a zigzag manner may be used. The linear portion may be arranged at an angle different from 0° or 180° with respect to the longitudinal direction L and/or may be also slightly bent. The retracted portion 25 may be formed to progressively bend away from the linear portion 23 in a bent fashion.

What is claimed is:

1. An electrical connector, comprising:

a male housing, a female housing having a receptacle into which the male housing is fittable, a lock portion for holding the female housing and the male housing connected, and at least one pair of compression springs to be compressed during the connection of the female and male housings and being provided in guide recesses on substantially opposite walls of the receptacle with respect to a widthwise direction, the compression springs being held substantially in contact with spring contact portions provided on the male housing in corresponding positions, the guide recesses on the female housing and the spring contact portions of the male housing being asymmetric with respect to a height direction, such that the spring contact portions of the male housing define a pair of upside-down insertion preventing ribs for preventing the upside-down insertion of the male housing into the receptacle.

2. A connector according to claim 1, wherein contact members are provided between the compression coil springs and the corresponding spring contact portions of the male housing, the contact members being displaceable along the guide recesses.

3. A connector according to claim 2, wherein the contact members comprise guided portions guided in guide grooves provided in the guide recesses.

4. A connector according to claim 3, wherein the guide grooves comprise an interaction portion and a retracted portion, wherein the contact members are engageable with the corresponding spring contact portion, when the guided portions are located in the interaction portion, and wherein the contact members are retractable from the corresponding spring contact portion, when the guided portions are located in the retracted portion.

5. A connector according to claim 4, wherein the interaction portion and the retracted portion are arranged at an angle different from 0° and 180° with respect to each other.

6. A connector according to claim 5, wherein the guide grooves comprise a rotation permitting portion, wherein the contact members being rotateable substantially around vertical axes by contact with the corresponding spring contact portion, for achieving a disengagement of the contact members and the corresponding spring contact portions.

7. A connector according to claim 6, wherein the compression springs are aligned to bias the contact members towards a rotational position substantially aligned with the interaction portions of the respective guide grooves.

8. A connector according to claim 7, wherein the contact members comprise a tapered surface which can interact with a mating tapered surface of the spring contact portion during disengagement of the two housings, thereby causing the rotation of the contact members substantially around their vertical axes.

9. A connector according to claim 8, wherein the compression springs are mounted to the female housing of the connector by boss portions.

10. An electrical connector assembly, comprising:

a female housing having a receptacle with at least one pair of opposed walls, guide recesses being formed in middle sections of the opposed walls with respect to a height direction, guide grooves provided in the guide recesses, the guide grooves each comprising an interaction portion and a retracted portion aligned to one another at an angle different from 0° and 180°;

a male housing engageable in the receptacle of the female housing, the male housing having a pair of opposite walls with spring contact portions disposed on the opposite walls for slidable engagement in the guide recesses of the female housing;

a lock portion for holding the female housing and the male housing connected;

at least one pair of compression springs disposed in the guide recesses, the compression springs being opposed to the spring contact portions on the male housing and being compressible during connection of the male and female housings; and contact members being provided between the compression coil springs and the corresponding spring contact portions of the male housing and being displaceable along the guide recesses, the contact members each comprising guided portions guided in the guide grooves, the contact members being engageable with the corresponding spring contact portion of the male housing when the guided portions are located in the interaction portion of the respective guide groove, and wherein the contact members are retractable from the corresponding spring contact portion when the guided portions are located in the retracted portion of the respective guide groove.

11. A connector according to claim 10, wherein the guide grooves comprise a rotation permitting portion, the contact members being rotatable substantially around vertical axes by contact with the corresponding spring contact portion, for achieving a disengagement of the contact members and the corresponding spring contact portions.

12. A connector according to claim 11, wherein the compression springs are aligned to bias the contact members towards a rotational position substantially aligned with the interaction portion of the respective guide groove.

13. A connector according to claim 12, wherein the contact members comprise a tapered surface which can interact with a mating tapered surface of the spring contact portion during disengagement of the two housings, thereby causing the rotation of the contact members substantially around their vertical axes.

* * * * *